US008469722B2

(12) United States Patent
Huang

(10) Patent No.: US 8,469,722 B2
(45) Date of Patent: Jun. 25, 2013

(54) PLUG CONNECTOR, RECEPTACLE CONNECTOR AND ELECTRICAL CONNECTOR ASSEMBLY

(75) Inventor: Sheng-yuan Huang, New Taipei (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/304,398

(22) Filed: Nov. 24, 2011

(65) Prior Publication Data

US 2013/0137306 A1 May 30, 2013

(51) Int. Cl.
*H01R 13/00* (2006.01)

(52) U.S. Cl.
USPC ..... 439/74

(58) Field of Classification Search
USPC ..... 439/74, 295, 660, 876, 733.1, 884
See application file for complete search history.

(56) References Cited

U.S. PATENT DOCUMENTS 7,465,171 B2 * 12/2008 Miyazaki et al. ..... 439/74
7,744,377 B2 * 6/2010 Wu et al. ..... 439/74
7,748,993 B2 * 7/2010 Midorikawa et al. ..... 439/74
7,758,352 B2 * 7/2010 Zeng ..... 439/74
7,985,099 B2 * 7/2011 Wu ..... 439/626
7,993,146 B2 * 8/2011 Midorikawa ..... 439/74
8,267,698 B2 * 9/2012 Ishikawa et al. ..... 439/17
2005/0101163 A1 * 5/2005 Obikane et al. ..... 439/74
2006/0040525 A1 * 2/2006 Takano et al. ..... 439/74
2006/0051988 A1 * 3/2006 Okura et al. ..... 439/74
2007/0141866 A1 * 6/2007 Kishi et al. ..... 439/74
2009/0061655 A1 * 3/2009 Miyazaki et al. ..... 439/74

* cited by examiner

*Primary Examiner* — Alexander Gilman
(74) *Attorney, Agent, or Firm* — Cheng-Ju Chiang

(57) ABSTRACT

A plug connector, a receptacle connector and an electrical connector assembly are provided. The plug connector includes a plug housing and a plurality of plug terminals located in the plug housing. Each plug terminal includes a first, second and third contact portions. The receptacle connector includes a receptacle housing and a plurality of receptacle terminals mounted in the receptacle housing. Each receptacle terminal includes a first, second and third side portions. When the plug connector and the receptacle connector are combined together to form the electrical connector assembly, the first, second and third contact portions respectively contact with the first, second and third side portions so that realizing a three-position contact between the plug and receptacle terminals for providing a stable signal transmission.

14 Claims, 4 Drawing Sheets

PLUG CONNECTOR, RECEPTACLE CONNECTOR AND ELECTRICAL CONNECTOR ASSEMBLY

BACKGROUND OF THE INVENTION

1. Field of the Invention

The present invention relates to a plug connector, a receptacle connector and an electrical connector assembly, and more particularly to a plug connector and a receptacle connector being mated together and to an electrical connector assembly having improved components, being capable of providing a stable hold and forming an electrical connection between two circuit boards.

2. Description of the Prior Art

At present, a connector mainly includes a housing and a plurality of terminals. The connector is mounted on a circuit board for being mated with a complementary connector. By the terminals of the two connectors contacting with each other, the two connectors form an electrical transmission therebetween. Therefore, the configuration of the terminal is one of the main factors of whether the terminal can provide a stable contact. In view of this, the traditional connector ordinarily disposes a plurality of terminals, each of which forms a plug portion for contacting with the complementary connector and enhancing the accuracy of the connection. But the configuration of the traditional terminal only can contact with the complementary terminal on single position thereof, so that it is apt to slip from the complementary terminal and result in unstable signal transmission or even signal interruption and so on and makes the connector suffer from the factors of the external shocks and the like. This is especially easy to occur in a board-to-board connector having multiple terminals.

Moreover, for the traditional board-to-board connector, the terminal and the complementary terminal mostly depend on a hard interference fit produced therebetween to be contacted with each other. But, the hard interference fit cannot provide a stable contact and is easily loosened and result in the bad electrical transmission because of the connector being pulled by the external shocks.

BRIEF SUMMARY OF THE INVENTION

For overcoming above defects, an object of the present invention is to provide a plug connector, a receptacle connector and an electrical connector assembly, which can form a stable connection and provide a stable signal transmission and are not easy to be effected by external shocks.

To achieve the above object, in accordance with the present invention, a plug connector is provided, comprising a plug housing, an inserting groove and a plurality of plug terminals. The plug housing is made of insulating material and has two opposite end walls, two sidewalls connected to the two end walls and spaced from each other, and a bottom plate connecting bottoms of the two end walls and the two sidewalls. The inserting groove is defined by the two end walls, the two side walls and the bottom plate and is used for accommodating a corresponding portion of a complementary connector. The plug terminals are spaced from each other and are orderly arranged on the two sidewalls. Each plug terminal includes a latch section, an interference section and a contact section. The interference section extends from one end of the latch section and disposes a first contact portion, which is located in and opens to the inserting groove. The contact portion extends from the other end of the latch section and disposes a second contact portion and a third contact portion. One end of the interference section away from the latch section is partially placed in the bottom plate. The second and third contact portions and the inserting groove are spaced by one of the two sidewalls.

To achieve the above object, in accordance with the present invention, a receptacle connector is also provided, comprising a receptacle housing, a plurality of terminal-receiving grooves, two engaging grooves and a plurality of receptacle terminals. The receptacle housing is made of insulating material and has two opposite end walls, two sidewalls connected to the two end walls, a bottom plate connecting bottoms of the two end walls and the two sidewalls, and a protruding plate standing on the bottom plate and being parallel to and located between the two sidewalls. Two opposite ends of the protruding plate and the two sidewalls are spaced away for respectively accommodating a corresponding part of a complementary connector. Each of the terminal-receiving grooves is together defined by the protruding plate, the corresponding sidewall and the bottom plate. The terminal-receiving grooves are spaced from each other and passes through top and bottom surfaces of the bottom plate and the two sidewalls. The two engaging grooves are respectively formed between the protruding plate and the two sidewalls for accommodating a complementary part of the complementary connector. The receptacle terminals are mounted in the terminal-receiving grooves from the below of the bottom plate. Each receptacle terminal includes a connecting section, a positioning section and a pressing section. The positioning section and the pressing section are respectively bent from two ends of the connecting section and are spaced from each other. The pressing section is tilted toward the positioning section. One end of the pressing section has a first side portion protruding from the protruding plate. The positioning section is U-shaped and located in the corresponding sidewall of the receptacle housing. The positioning section has a second side portion and a third side portion bent from the second side portion. An angle between the second and third side portions is less than 90 degrees.

To achieve the above object, in accordance with the present invention, an electrical connector assembly is also provided, comprising a plug connector and a receptacle connector. The plug connector comprises a plug housing and a plurality of plug terminals located in the plug housing. Each plug terminal includes a first, second and third contact portions. The receptacle connector comprises a receptacle housing and a plurality of receptacle terminals mounted in the receptacle housing. Each receptacle terminal includes a first, second and third side portions. When the plug connector and the receptacle connector are combined together, the first, second and third contact portions respectively contact with the first, second and third side portions so that realizing a three-position contact between the plug and receptacle terminals for providing a stable signal transmission.

Based on the above description, the first, second and third contact portions of each plug terminal of the plug connector of the present invention respectively contact with the first, second and third side portions of each receptacle terminal of the receptacle connector of the present invention, so that the plug and receptacle terminals can realize a three-position contact for providing a stable signal transmission, assuring a stable combination and being not easy to be effected by external shocks.

DETAILED DESCRIPTION OF THE PREFERRED EMBODIMENTS

Figure 1:
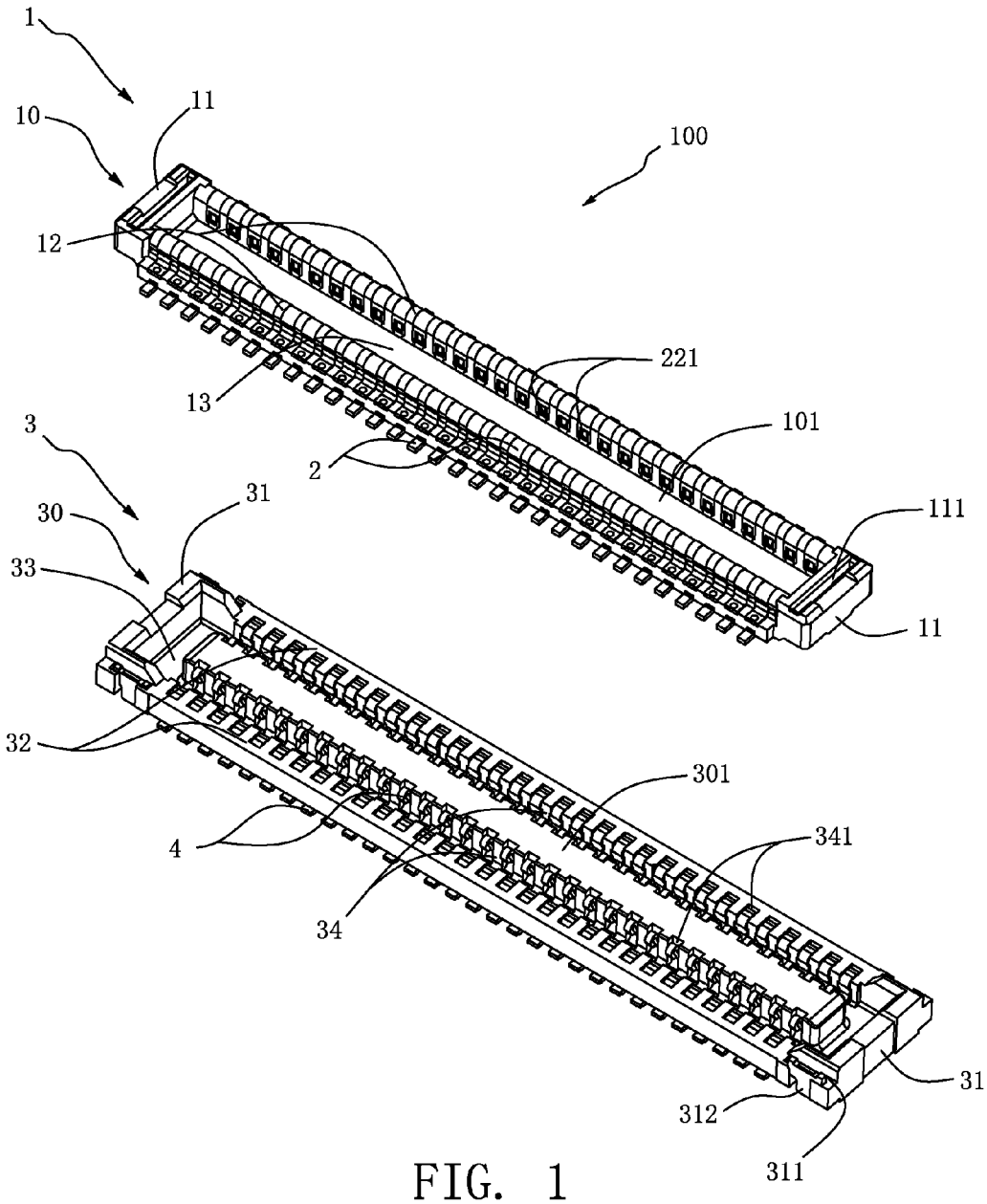
FIG. 1 is a perspective view of a plug connector and a receptacle connector of an electrical connector assembly of the present invention.
Figure 2:
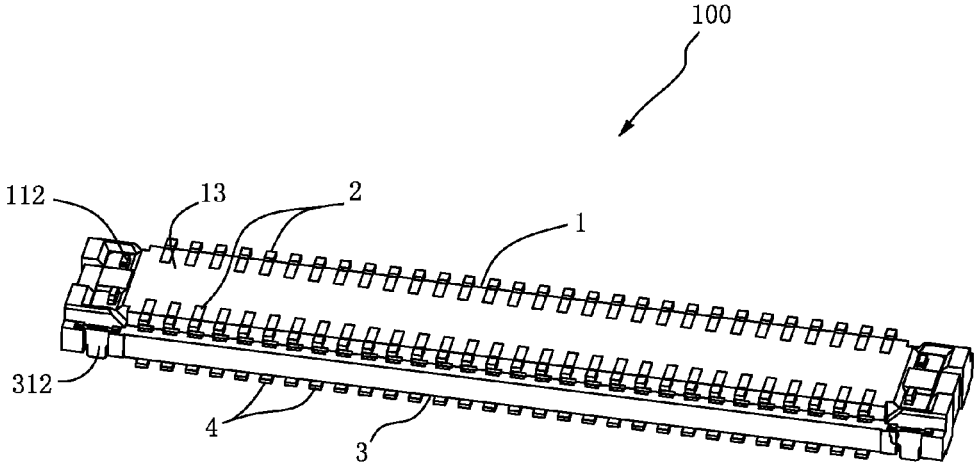
FIG. 2 is an assembly view of FIG. 1.

Please refer to FIGS. 1 to 4, which are one preferred embodiment of an electrical connector assembly 100 of the present invention, the electrical connector assembly 100 of the present invention comprises a plug connector 1 and a receptacle connector 3 mated with each other.

Please again refer to FIGS. 1 and 3, the plug connector 1 comprises a plug housing 10 being rectangular strip-shaped and being made of insulating material. The plug housing 10 has two opposite end walls 11 extending along a short axis thereof, two opposite sidewalls 12 extending along a long axis thereof, and a bottom plate 13 connecting bottoms of the two end walls 11 and the two sidewalls 12. Each of the two end walls 11 disposes a positioning groove 111 passing through a top and bottom surfaces thereof. A flux member 112 (shown in FIG. 2) is mounted in the positioning groove 111 for strengthening the connection of the plug housing 10 and one circuit board (not shown in all FIGS.). The plug connector 1 further comprises an inserting groove 101 together defined by the two end walls 11, the two sidewalls 12 and the bottom plate 13. The plug connector 1 further comprises a plurality of plug terminals 2 being made of metal material and orderly arranged on the two sidewalls 12.

Please again refer to FIGS. 1 and 3, each plug terminal 2 includes a latch section 21, an interference section 22 and a contact section 23. The latch section 21 is U-shaped. The interference section 22 extends from one end of the latch section 21 and disposes a first contact portion 221 located and opening in the inserting groove 101. One end of the interference section 22 away from the latch section 21 is bent and then extends to form a solder portion 222. The contact section 23 extends from the other end of the latch section 21 and is bent to be inverted L-shaped. The contact section 23 has a second contact portion 231 and a third contact portion 232. The second contact portion 231 is disposed near the other end of the latch section 21, and the third contact portion 232 is disposed on one bent end of the contact section 23. The second and third contact portions 231, 232 and the inserting groove 101 are spaced by the sidewall 12. In other words, after each plug terminal 2 is located on the plug housing 10, the latch section 21 of the plug terminal 12 rides on the corresponding sidewall 12. The solder portion 222 of the interference section 22 is positioned in a terminal-receiving groove located on the bottom plate 13, and is partly exposed out of the plug housing 10 for being solder onto the circuit board (not shown in all FIGS.).

Figure 3:
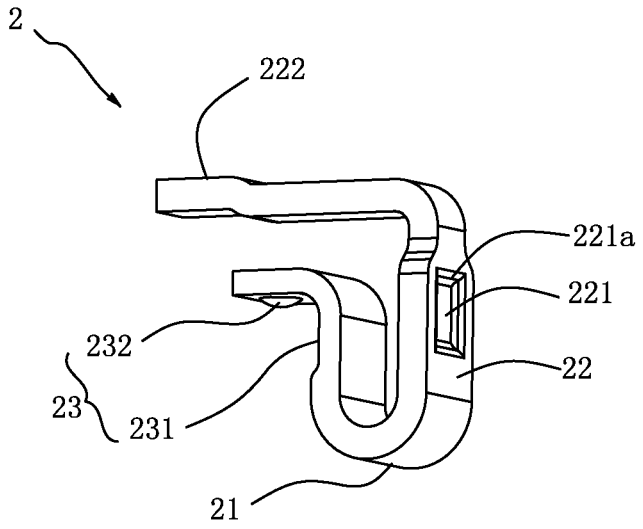
FIG. 3 is a schematic view of a plug terminal of the plug connector.

Please refer to FIG. 3, in this preferred embodiment, the first contact portion 221 of the interference section 22 of the plug terminal 2 is a recess, which is concaved inward from one surface of the interference section 22. The peripheral edges of the recess 221 are oblique side or arc side 221*a*. The other surface of the interference section 22 opposite to the recess leans against the sidewall 12. The second contact portion 231 of the contact section 23 is concaved from one surface of the latch section for increasing the contact area between the plug terminal 2 and a complementary terminal. The third contact portion 232 is a protrusion protruding from the surface of the contact section 23. However, the first, second and third contact portions 221, 231, 232 should not be limited to abovementioned configuration. For example, in other embodiments, the first and second contact portions 221, 231 may be a protrusion.

Please refer to FIGS. 1 to 4, the receptacle connector 3 of the electrical connector assembly 100 of the present invention comprises a receptacle housing 30 being made of insulating material. The receptacle housing 30 has two opposite end walls 31, two opposite sidewalls 32 being perpendicular to and connected to the two end walls 31, a bottom plate 33 connecting the bottoms of the two end walls 31 and the two sidewalls 32, and a protruding plate 301 protruding on the bottom plate 33, being located between the two sidewalls 32 and being parallel to the two sidewalls 32. Two opposite ends of the protruding plate 301 and the two sidewalls 11 are spaced away for respectively accommodating the two end walls 11 of the plug connector 1. Each of the two end walls 31 disposes a positioning groove 311 formed outside thereof and passing through a top and bottom surfaces of the end wall 31. A flux member 312 (shown in FIGS. 1 and 2) is mounted in the positioning groove 311 for strengthening the connection of the receptacle housing 30 and the other circuit board (not shown in all FIGS.). Moreover, the receptacle connector 3 has two engaging grooves 34 respectively formed between two longitudinal sides of the protruding plate 301 and the two sidewalls 32, a plurality of terminal-receiving grooves 341 together defined by the protruding plate 301, the two sidewalls 32 and the bottom plate 33. The terminal-receiving grooves 341 are spaced from each other and pass through the top and bottom surfaces of the bottom plate 33 and the two sidewalls 32. The receptacle connector 3 further comprises a plurality of receptacle terminals 4 being made of metal material and mounted into the terminal-receiving grooves 341 from the below of the bottom plate 33.

Figure 4:
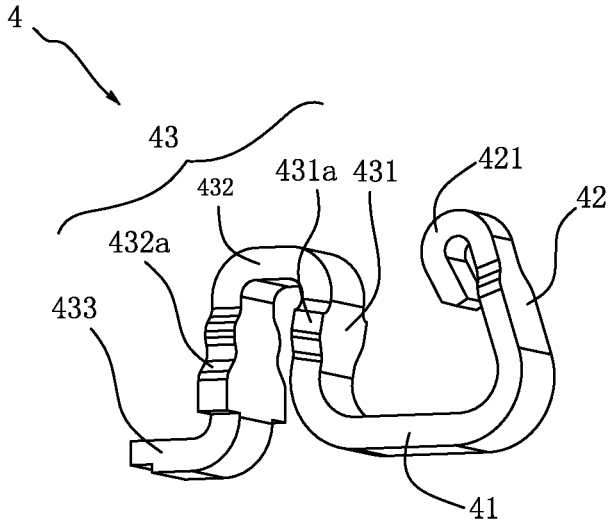
FIG. 4 is a schematic view of a receptacle terminal of the receptacle connector.

Please refer to FIG. 4, each receptacle terminal 4 includes a connecting section 41, a pressing section 42 and a positioning section 43. The pressing section 42 and the positioning section 43 are respectively bent from two ends of the connecting section 41 and are spaced from each other. The pressing section 42 is tilted toward the positioning section 43. One end of the pressing section 42 has a first side portion 421. The positioning section 43 is U-shaped and located in the sidewall 32 of the receptacle housing 30. The positioning section 43 has a second side portion 431 and a third side portion 432 bent from the second side portion 431.

Please refer to FIG. 4, in this preferred embodiment, the first side portion 421 of the pressing section 42 protrudes from the protruding plate 301 and is bent to form an arc surface for contacting with the first contact portion 221 of the plug terminal 2 of the plug connector 1. The second side portion 431 disposes a wing portion 431*a* extending outward from two opposite sides thereof. One end of the positioning section 43 away from the connecting section 41 is further bent to form a solder portion 433 for being soldered onto the circuit board (not shown). The angle between the second and third side portions 431, 432 is less than 90 degrees so that the second side portion forms a prominent ridge for leaning against the second contact portion 231 of the plug terminal 2 of the plug connector 1. Moreover, the U-shaped positioning section 43 further disposes a wing portion 432*a* protruding outward on another edge thereof opposite to the second side portion 431.

Figure 5:
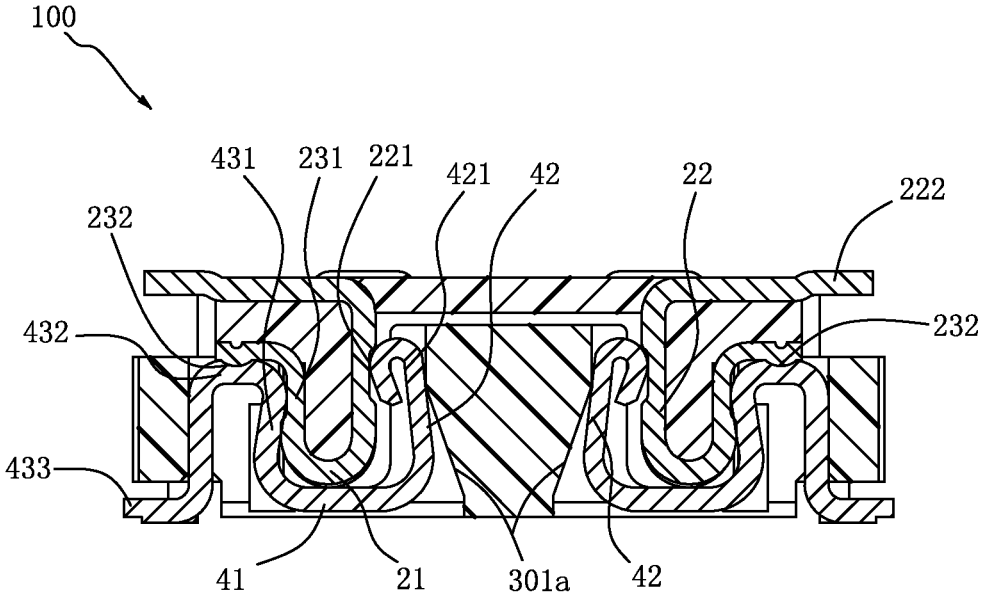
FIG. 5 is one sectional view of FIG. 2.

Please refer to FIGS. 3 to 5, when the plug connector 1 and the receptacle connector 3 of the electrical connector assembly 100 are mated together, the protruding plate 301 of the receptacle connector 3 is accommodated in the inserting groove 101 of the plug connector 1, the two sidewalls 12 located two sides of the inserting groove 101 are respectively inserted into the engaging grooves 34 located on two sides of the protruding plate 301, the two end walls 11 of the plug connector 1 are respectively filled into the spaces between the protruding plate 301 and the two end walls 31. In other words, the two end walls 31 and the two sidewalls 32 of the receptacle connector 3 surround the two end walls 11 and the two sidewalls 12 of the plug connector 1. After the two connectors 1, 3 are combined together, the first, second and third contact portions 221, 231, 232 of each plug terminal 2 of the plug connector 1 are respectively corresponding to and contact with the first, second and third side portions 421, 431, 432. When the first side portion 421 contacts with the recess of the first contact portion 221, the first side portion 421 will rotate toward a resisting wall 301*a* of the protruding plate 301. This will drive the second side portion 431 to move toward the second contact portion 231, so that the prominent ridge constructed by the second and third side portion 431, 432 can more stably lean against the recess of the second contact portion 231. The third contact portion 232 is pressed upon the third side portion 432 (as shown in FIG. 5).

As described above, the plug connector, the receptacle connector and the electrical connector assembly of the present invention have the aid of the configuration of the plug terminal 2 and the receptacle terminal 4 to realize a three-position contact for providing a stable signal transmission, assuring a stable combination and being not easy to be effected by external shocks.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A plug connector, comprising:

a plug housing, being made of insulating material and having two opposite end walls, two sidewalls connected to the two end walls and spaced from each other, and a bottom plate connecting bottoms of the two end walls and the two sidewalls;

an inserting groove, being defined by the two end walls, the two side walls and the bottom plate and being used for accommodating a corresponding portion of a complementary connector; and a plurality of plug terminals, being spaced from each other and being orderly arranged on the two sidewalls;

wherein each plug terminal includes a latch section, an interference section and a contact section; the interference section extending from one end of the latch section and disposing a first contact portion, which is located in and opens to the inserting groove; the contact portion extending from the other end of the latch section and disposing a second contact portion and a third contact portion; one end of the interference section away from the latch section being partially placed in the bottom plate; and the second and third contact portions and the inserting groove being spaced by one of the two sidewalls, and wherein the second contact portion of the contact section is concaved from one surface of the latch section; and the third contact portion is a protrusion.

2. The plug connector as claimed in claim 1, wherein the first contact portion of the interference section is a recess, which is concaved inward from one surface of the interference section, and the other surface of the interference section is opposite to the recess leans against the corresponding sidewall.

3. The plug connector as claimed in claim 1, wherein the latch section is U-shaped and rides on the corresponding sidewall and the contact section is L-shaped.

4. The plug connector as claimed in claim 3, wherein the interference section of the plug terminal is bent and extends to form a solder portion, which is partially exposed out of the plug housing, on one end thereof entering into the bottom plate.

5. The plug connector as claimed in claim 1, wherein the plug connector further comprises two flux members, which are respectively mounted in the two end walls of the plug housing.

6. An electrical connector assembly, comprising a plug connector and a receptacle connector, the plug connector, comprising:

a plug housing, being made of insulating material and having two opposite end walls, two sidewalls connected to the two end walls and spaced from each other, and a bottom plate connecting bottoms of the two end walls and the two sidewalls;

an inserting groove, being defined by the two end walls, the two side walls and the bottom plate and being used for accommodating a corresponding portion of the receptacle connector; and a plurality of plug terminals, being spaced from each other and being orderly arranged on the two sidewalls;

wherein each plug terminal includes a latch section, an interference section and a contact section; the interference section extending from one end of the latch section and disposing a first contact portion, which is located in and opens to the inserting groove; the contact portion extending from the other end of the latch section and disposing a second contact portion and a third contact portion; one end of the interference section away from the latch section being partially placed in the bottom plate; and the second and third contact portions and the inserting groove being spaced by one of the two sidewalls, and wherein the second contact portion of the contact section is concaved from one surface of the latch section; and the third contact portion is a protrusion;

the receptacle connector, comprising:

a receptacle housing, being made of insulating material and having two opposite end walls, two sidewalls connected to the two end walls, a bottom plate connecting bottoms of the two end walls and the two sidewalls, and a protruding plate standing on the bottom plate and being parallel to and located between the two sidewalls, wherein two opposite ends of the protruding plate and the two sidewalls are spaced away for respectively accommodating a corresponding part of the plug connector;

a plurality of terminal-receiving grooves, each of which is together defined by the protruding plate, the corresponding sidewall and the bottom plate, the terminal-receiving grooves being spaced from each other and passing through top and bottom surfaces of the bottom plate and the two sidewalls;

two engaging grooves respectively formed between the protruding plate and the two sidewalls for accommodating a complementary part of the plug connector; and a plurality of receptacle terminals, being mounted in the terminal-receiving grooves from the below of the bottom plate;

wherein each receptacle terminal includes a connecting section, a positioning section and a pressing section; the positioning section and the pressing section being respectively bent from two ends of the connecting section and being spaced from each other; the pressing section being tilted toward the positioning section; one end of the pressing section having a first side portion protruding from the protruding plate; the positioning section being U-shaped and located in the corresponding sidewall of the receptacle housing; the positioning section having a second side portion and a third side portion bent from the second side portion; and an angle between the second and third side portions being less than 90 degrees.

7. The electrical connector assembly as claimed in claim 6, wherein the first contact portion of the interference section is a recess, which is concaved inward from one surface of the interference section, and the other surface of the interference section is opposite to the recess leans against the corresponding sidewall.

8. The electrical connector assembly as claimed in claim 6, wherein the latch section is U-shaped and rides on the corresponding sidewall and the contact section is L-shaped.

9. The electrical connector assembly as claimed in claim 8, wherein the interference section of the plug terminal is bent and extends to form a solder portion, which is partially exposed out of the plug housing, on one end thereof entering into the bottom plate.

10. The electrical connector assembly as claimed in claim 6, wherein the plug connector further comprises two flux members, which are respectively mounted in the two end walls of the plug housing.

11. The electrical connector assembly as claimed in claim 6, wherein the first side portion is bent to form an arc surface, the second side portion disposes a wing portion extending outward from two opposite sides thereof, and one end of the positioning section is bent to form a solder portion.

12. The electrical connector assembly as claimed in claim 6, wherein the protruding plate disposes a resisting wall on the position of each terminal-receiving groove, and the resisting wall is a slop standing on the bottom plate, and the pressing section and the resisting wall have a same inclined angle.

13. The electrical connector assembly as claimed in claim 6, wherein the receptacle housing disposes a positioning groove, which is provided for a flux member to be mounted therein, on the outside of the two sidewalls.

14. A plug connector, comprising:

a plug housing, being made of insulating material and having two opposite end walls, two sidewalls connected to the two end walls and spaced from each other, and a bottom plate connecting bottoms of the two end walls and the two sidewalls;

an inserting groove, being defined by the two end walls, the two side walls and the bottom plate and being used for accommodating a corresponding portion of a complementary connector; and a plurality of plug terminals, being spaced from each other and being orderly arranged on the two sidewalls;

wherein each plug terminal includes a latch section, an interference section and a contact section; the interference section extending from one end of the latch section and disposing a first contact portion, which is located in and opens to the inserting groove; the contact portion extending from the other end of the latch section and disposing a second contact portion and a third contact portion; one end of the interference section away from the latch section being partially placed in the bottom plate; and the second and third contact portions and the inserting groove being spaced by one of the two sidewalls, and wherein the latch section is U-shaped and rides on the corresponding sidewall and the contact section is L-shaped.

* * * * *